US011867428B2

(12) United States Patent
Gao et al.

(10) Patent No.: US 11,867,428 B2
(45) Date of Patent: Jan. 9, 2024

(54) HEAT EXCHANGE PIPE, HEAT EXCHANGER AND WATER HEATING APPARATUS

(71) Applicant: A.O. SMITH (CHINA) WATER HEATER CO., LTD., Jiangsu (CN)

(72) Inventors: Xiang Gao, Jiangsu (CN); Dian Fang, Jiangsu (CN); Xiaowei Zhou, Jiangsu (CN)

(73) Assignee: A.O. Smith Corporation, Milwaukee, WI (US)

( * ) Notice: Subject to any disclaimer, the term of this patent is extended or adjusted under 35 U.S.C. 154(b) by 153 days.

(21) Appl. No.: 17/136,533

(22) Filed: Dec. 29, 2020

(65) Prior Publication Data

US 2021/0333013 A1 Oct. 28, 2021

(30) Foreign Application Priority Data

Apr. 28, 2020 (CN) ..... 202010348653.4

(51) Int. Cl.

| | |
|---|---|
| ***F24H 1/43*** | (2022.01) |
| ***F24H 9/00*** | (2022.01) |
| ***F28D 7/04*** | (2006.01) |
| ***F28F 1/32*** | (2006.01) |

(52) U.S. Cl.

CPC ..... *F24H 1/43* (2013.01); *F24H 9/0026* (2013.01); *F28D 7/04* (2013.01); *F24D 2200/18* (2013.01); *F28F 1/325* (2013.01)

(58) Field of Classification Search

CPC .... F24H 1/403; F24H 9/0031; F28F 2215/06; F28D 7/04

See application file for complete search history.

(56) References Cited

U.S. PATENT DOCUMENTS

| | | | | |
|---|---|---|---|---|
| 4,502,626 A * | 3/1985 | Gerstmann | ..... | F24D 12/02 122/33 |
| 5,163,508 A * | 11/1992 | Hamos | ..... | F28F 1/36 165/181 |
| 2005/0120981 A1* | 6/2005 | Ferguson | ..... | F24H 1/40 122/367.3 |
| 2005/0133202 A1 | 6/2005 | Jorgensen et al. | | |

(Continued)

FOREIGN PATENT DOCUMENTS

| | | | | |
|---|---|---|---|---|
| CA | 2938331 A1 * | 2/2011 | ..... | F24H 1/165 |
| CN | 206556255 | 10/2017 | | |

(Continued)

OTHER PUBLICATIONS

English Translation of CN-107702583-A (Year: 2018).*

*Primary Examiner* — Steven S Anderson, II
*Assistant Examiner* — Kurt J Wolford
(74) *Attorney, Agent, or Firm* — Michael Best & Friedrich LLP

(57) ABSTRACT

The present disclosure discloses a heat exchange pipe, a heat exchanger and a water heating apparatus. The heat exchange pipe comprises: a pipe body and a plurality of fins fixedly disposed to sleeve the pipe body; a flow guiding structure is provided at a partial outer edge of the fin; and a flow guiding flue is formed between the flow guiding structure and an outer wall of the pipe body. The heat exchange pipe, the heat exchanger and the water heating apparatus provided by the present disclosure can improve the flue gas flow path and the heat exchange efficiency.

35 Claims, 6 Drawing Sheets

(56) References Cited

U.S. PATENT DOCUMENTS

| | | | | |
|---|---|---|---|---|
| 2007/0188992 | A1* | 8/2007 | Hwang | F28F 1/30 361/695 |
| 2011/0041781 | A1* | 2/2011 | Deivasigamani | F24H 1/44 165/184 |
| 2014/0054015 | A1* | 2/2014 | Boehm | B21D 11/06 165/172 |
| 2015/0007779 | A1* | 1/2015 | Cui | F28F 1/36 122/20 B |

FOREIGN PATENT DOCUMENTS

| | | | | |
|---|---|---|---|---|
| CN | 107702583 | A * | 2/2018 | |
| WO | WO-2021026397 | A1 * | 2/2021 | B23K 1/0012 |
| WO | WO-2021113516 | A1 * | 6/2021 | |

* cited by examiner

HEAT EXCHANGE PIPE, HEAT EXCHANGER AND WATER HEATING APPARATUS

CROSS REFERENCE TO RELATED APPLICATION

This application claims the priority to the Chinese Patent Application No. 202010348653.4, filed on Apr. 28, 2020, which is hereby incorporated by reference its entirety.

TECHNICAL FIELD

The present disclosure relates to the technical field of water heating apparatuses, in particular to a heat exchange pipe, a heat exchanger and a water heating apparatus.

BACKGROUND

At present, the heat exchanger of a gas water heater is equipped with a heat exchange pipe that exchanges heat with flue gas. In order to increase the heat exchange area outside the pipe and increase the heat exchange amount of the heat exchange pipe, finned tubes are usually used as the heat exchange pipe. By processing many fins on the surface of the tube body of finned tubes, the original surface of the tube body is expanded and improved, the heat exchange area and heat exchange amount are increased.

However, the partition gaps between fins of the existing finned tubes are designed to be opened outwardly, which leads to an insufficient contact between flue gas and the tube body, resulting in low heat exchange efficiency.

In addition, in order to improve the heat exchange efficiency of finned tubes, in some water heaters, a flue gas baffle sheet is added on one side of the finned tube to allow full contact of flue gas with the finned tube and prevent flue gas from flowing too fast, thereby improving the heat exchange efficiency. However, this will increase the manufacturing cost, and the flue gas baffle sheet needs to be mounted on one side of the gap outlet of two adjacent circles of the finned tube. The installation accuracy is difficult to control, and the installation difficulty is great, but if the mounting position of the flue gas baffle sheet is not accurate the heat exchange efficiency will be greatly affected.

SUMMARY

In view of the above deficiencies, one purpose of the present disclosure is to provide a heat exchange pipe, a heat exchanger and a water heating apparatus, so as to improve the flue gas flow path and heat exchange efficiency.

Another purpose of the present disclosure is to provide a heat exchange pipe, a heat exchanger and a water heating apparatus that cost low and are easy to install.

To achieve at least one of the purposes, the present disclosure adopts the following technical solutions:

A heat exchange pipe, comprising a pipe body and a plurality of fins fixedly disposed to sleeve the pipe body, a flow guiding structure being provided at a partial outer edge of the fin, and a flow guiding flue being formed between the flow guiding structure and an outer wall of the pipe body.

As a referred embodiment, the fin has a first portion in which an outer edge is provided with the flow guiding structure, and a second portion in which an outer edge is not provided with the flow guiding structure; in a case where a part of the fin is intercepted at a same central angle, a heat exchange area of an intercepted part of the first portion is larger than that of an intercepted part of the second portion.

As a referred embodiment, in a case where a part of the fin is intercepted at a same central angle, a difference between the heat exchange area of the intercepted part of the first portion and the heat exchange area of the intercepted part of the second portion is approximately an heat exchange area of the flow guiding structure of the intercepted part.

As a referred embodiment, at least a partial length of the flow guiding structure has a preset width; a direction of the width is a direction of a spacing between adjacent two of the fins; and the preset width is more than 0.9 times the spacing between adjacent two of the fins.

As a referred embodiment, in the adjacent two of the fins, the flow guiding structure of one of the fins is in contact and attached with the other of the fins.

As a referred embodiment, an attaching length of the flow guiding structure accounts for more than 0.8 of a length of the whole flow guiding structure.

As a referred embodiment, at least a partial length of the flow guiding structure extends around the pipe body with a constant width.

As a referred embodiment, at least a partial length of the flow guiding flue extends around the pipe body with a constant flow area.

As a referred embodiment, a spacing between an outer edge of the fin not provided with the flow guiding structure and the outer wall of the pipe body is L1, and a spacing between the flow guiding structure and the pipe body is L2, wherein $0.5 \leq L1 \leq L2 \leq 1.5L1$.

As a referred embodiment, a flue gas inlet communicated with the flow guiding flue and a flue gas outlet communicated with the flow guiding flue are provided between adjacent two of the fins; wherein the heat exchange pipe has an incident side facing flue gas and an effluent side facing away from the flue gas; the flue gas outlet is located on the effluent side, and the flow guiding structures are located on two sides of the flue gas outlet along a circumferential direction.

As a referred embodiment, the flow guiding structures located on the two sides of the flue gas outlet along the circumferential direction have a same length.

As a referred embodiment, the flue gas inlet is located on the incident side; and a length of the flue gas inlet along the circumferential direction is larger than that of the flue gas outlet.

As a referred embodiment, more than half of a length of the flow guiding structure is located on the effluent side.

As a referred embodiment, the flow guiding structure extends along a circumferential direction.

As a referred embodiment, the flow guiding structures are integrated with the fin, and the flow guiding structures are flow guiding flangings located at an outer edge of the fin.

As a referred embodiment, a length of the flue gas inlet along the circumferential direction is less than half of a perimeter of an outer edge of the fin.

As a referred embodiment, a spacing between the flow guiding structure and the pipe body is L2; and a length of the flue gas outlet is 0.5L2 to 3L2 along a direction around the pipe body.

As a referred embodiment, a ratio of a length of the flow guiding flangings to a length of an outer edge of the fin is 0.3 to 0.7 along a direction around the pipe body.

As a referred embodiment, on the pipe body, the flue gas outlets of a first number of fins are aligned along an arrangement direction, while the flue gas outlets of a second number of fins are aligned along an arrangement direction and staggered with the flue gas outlets of the first number of fins along the circumferential direction.

As a referred embodiment, the flue gas outlets of the first number of fins and the flue gas outlets of the second number of fins are staggered by 90 degrees along the circumferential direction.

A heat exchanger, having a spirally coiled heat exchange pipe which comprises a pipe body and a plurality of fins fixedly disposed to sleeve the pipe body, a flow guiding structure being provided at a partial outer edge of the fin, and a flow guiding flue being formed between the flow guiding structure and an outer wall of the pipe body.

As a referred embodiment, the outer edges of the fins of adjacent two circles of the heat exchange pipe are attached to each other.

As a referred embodiment, the heat exchange pipe comprises an inner coiled pipe and an outer coiled pipe surrounding the inner coiled pipe; a partition board is provided between the inner coiled pipe and the outer coiled pipe; a flue gas outlet of a flow guiding flue of the inner coiled pipe faces the partition board.

As a referred embodiment, the outer coiled pipe is spirally coiled around a central axis; an orientation of the flue gas outlet of the outer coiled pipe is parallel to the central axis.

As a referred embodiment, in the outer coiled pipe, the flue gas outlet of the flow guiding flue of one circle of the heat exchange pipe faces the flue gas inlet of the flow guiding flue of a next circle of the heat exchange pipe.

A gas water heating device, comprising: a gas exchanger as described in any one of the above embodiments.

Advantageous Effect

The heat exchange pipe provided by one embodiment of the present disclosure forms a flow guiding flue by using the flow guiding structures on the fins, and the flow guiding flue can guide flue gas to the surface of the pipe body of the heat exchange pipe, so that outward diffusion of flue gas between the fins is avoided and the heat exchange efficiency of the heat exchange pipe is improved.

In addition, adopting the heat exchange pipe provided by this embodiment does not require mounting of a flue gas baffle sheet in the heat exchanger. This reduces the installation difficulty and is of great practical value.

Particular embodiments of the present disclosure are disclosed in detail with reference to the descriptions and figures given below, and the ways in which the principle of the present disclosure can be employed are pointed out. It should be appreciated that the embodiments of the present disclosure are not limited in scope thereby.

Features which are described and/or indicated for one embodiment can be used in one or more other embodiments in an identical or similar way, can be combined with features in the other embodiments, or can replace the features in the other embodiments.

It should be emphasized that the term "comprise/include" used in this text refers to the presence of features, integers, steps or components, but does not exclude the presence or addition or one or more other features, integers, steps or components.

BRIEF DESCRIPTION OF THE DRAWINGS

In order to explain more clearly the technical solutions in the embodiments of the present disclosure or in the prior art, the following will briefly introduce the figures needed in the description of the embodiments or the prior art. Obviously, figures in the following description are only some embodiments of the present disclosure, and for a person skilled in the art, other figures may also be obtained based on these figures without paying creative efforts.

DETAILED DESCRIPTION

Figure 1:
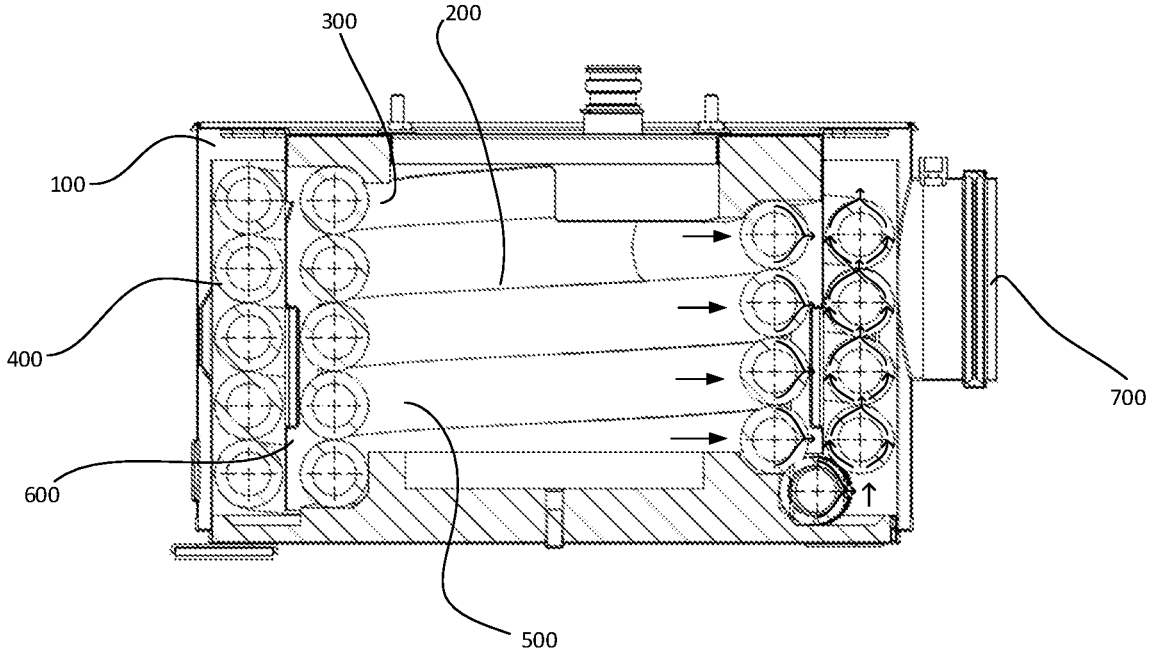
FIG. 1 is a cutaway view of the heat exchanger provided by an embodiment of the present disclosure.

In order to enable persons skilled in the art to better understand the technical solutions in the present disclosure, a clear and comprehensive description to the technical solutions in the embodiments of the present disclosure will be made in the following in combination with the figures in the embodiments of the present disclosure, and obviously, the embodiments described in this text are only part of the embodiments of the present disclosure rather than all the embodiments of the present disclosure. Based on the embodiments of the present disclosure, all other embodiments obtained by ordinary skilled persons in the field without paying creative efforts should pertain to the scope of protection of this disclosure.

What needs to be explained is that, when an element is referred to as being "provided on" another element, it can be directly on the other element, or an intervening element may also be present. When an element is considered to be "connected to" another element, it can be directly connected to the other element, or an intervening element may also be present. The terms "perpendicular", "horizontal", "left" and "right" as well as similar expressions used in the text are only for the purpose of explanation, and do not represent the unique embodiment.

Unless otherwise defined, all technical and scientific terms used in the text have the same meaning as commonly understood by persons pertaining to the technical field of the present disclosure. The terminology used in the Description of the present disclosure is for the purpose of describing the specific embodiments only, and is not intended to limit the present disclosure. The term "and/or" used in the text includes any and all combinations of one or more of the associated listed items.

Referring to FIGS. 1 to 9, an embodiment of the present disclosure provides a heat exchange pipe 500 comprising a pipe body 20 and a plurality of fins 1 fixedly disposed to sleeve the pipe body 20. A flow guiding structure 3 is provided at a partial outer edge 8 of the fin 1, and a flow guiding flue 6 is formed between the flow guiding structure 3 and an outer wall of the pipe body 20.

The heat exchange pipe 500 provided by this embodiment forms the flow guiding flue 6 by using the flow guiding structures 3 on the fins 1, and the flow guiding flue 6 can guide flue gas to the surface of the pipe body 20 of the heat exchange pipe 500, so that outward diffusion of flue gas between the fins 1 is avoided and the heat exchange efficiency of the heat exchange pipe 500 is improved.

In addition, adopting the heat exchange pipe 500 provided by this embodiment does not require mounting of a flue gas baffle sheet in the heat exchanger, which reduces the installation difficulty and is of great practical value.

Figure 4:
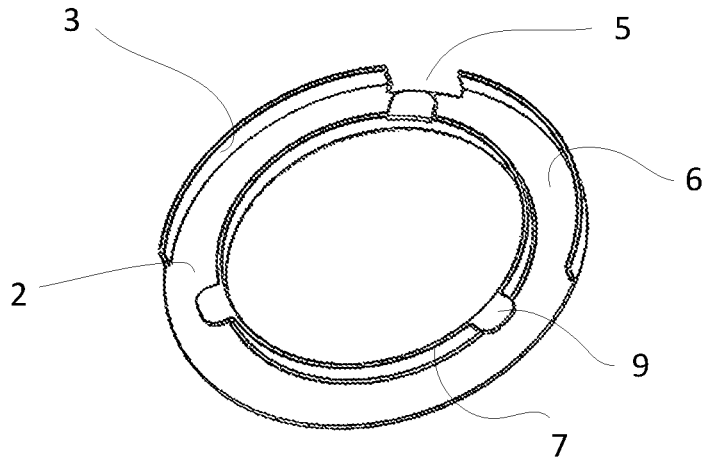
FIG. 4 is a structural diagram of the fin in FIG. 2.
Figure 5:
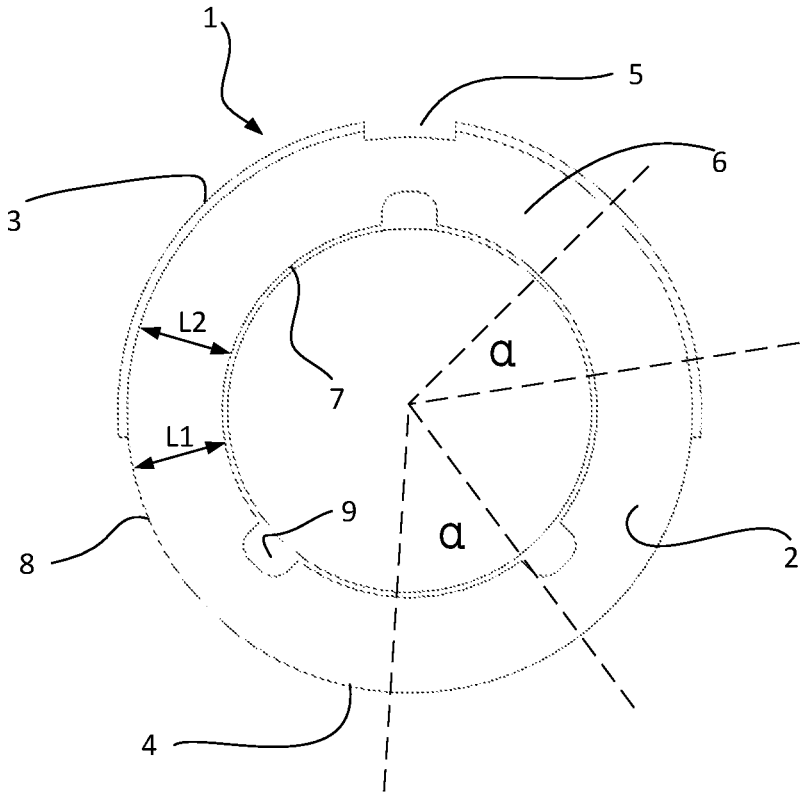
FIG. 5 is a front view of FIG. 4.

In this embodiment, as shown in FIGS. 4 and 5, the fin 1 may comprise an annular main body 2 and the flow guiding structure 3 located on the partial outer edge 8 of the annular body 2. The annular main body 2 is preferably in a circular ring shape, and of course may also be in other shapes such as a rectangular ring shape and other polygonal ring shapes. Surfaces of the annular main bodies 2 of adjacent two of the fins 1 are parallel, and may both be substantially parallel to the outer surface of the pipe body 20.

A partition gap is formed between two adjacent annular main bodies 2. The flow guiding structure 3 covers the partition gap at the outer edge 8 of the annular main body 2, so that the flow guiding structure 3, (walls of) the two adjacent annular main bodies 2 and the outer wall of the pipe body 20 can enclose the flow guiding flue 6. The flow guiding structure 3 can avoid the outward diffusion of flue gas in the flow guiding flue 6, ensuring that the flue gas exchange heat with the fin 1 and the pipe body 20 as much as possible, thereby improving the heat exchange efficiency.

In this embodiment, the flow guiding structure 3 extends along the outer edge 8 of the annular main body 2. The flow guiding structure 3 and the annular main body 2 may form a bent structure. The flow guiding structure 3 and the annular main body 2 may be perpendicular to each other, and of course, they may also form an acute angle or an obtuse angle. The present disclosure does not give a special limitation to this.

As can be seen in FIGS. 4 and 5, the flow guiding structure 3 extends in a circumferential direction. The flow guiding structure 3 is an arc structure that extends at the outer edge 8 of the annular main body 2 along the circumferential direction, and at this point the shape of the flow guiding structure 3 is a rectangular strip when in a tiled state. The flow guiding structure 3 is integrated with the fin 1, and the flow guiding structure 3 is a flow guiding flanging located at the outer edge 8 of the fin 1. Preferably, the fin 1 is formed by stamping. In other embodiments, the flow guiding structure 3 may also be a non-flanging structure that may be a shielding strip welded on the outer edge 8 of the annular main body 2.

The fin 1 also has an inner ring 7, and one end of the inner ring 7 has a plurality of positioning protrusions 9 along the circumferential direction. As shown in FIGS. 4 and 5, the inner ring 7 of the fin 1 has three positioning protrusions 9. Adjacent two fins 1 can be positioned by positioning protrusions 9, ensuring a target spacing between the two adjacent fins 1. Of course, the adjacent fins 1 of the heat exchange pipe 500 of this embodiment may also be attached and positioned by the flow guiding structure 3. The fins 1 can be dual positioned on the pipe body 20 by the flow guiding structure 3 in combination with the inner ring 7. Hence, accurate positioning between adjacent fins 1 can be ensured, which facilitates the installation.

In this embodiment, the heat exchange area of the fins 1 can be enlarged by adding flow guiding structures 3, and thereby the heat exchange efficiency of the heat exchange pipe 500 is improved. To be specific, the fin 1 has a first portion in which an outer edge 8 is provided with the flow guiding structure 3, and a second portion in which an outer edge 8 is not provided with the flow guiding structure 3. In a case where a part of the fin 1 is intercepted at a same central angle $\alpha$, the heat exchange area of the intercepted part of the first portion is larger than that of the intercepted part of the second portion.

Further, in a case where a part of the fin 1 is intercepted at a same central angle, a difference between the heat exchange area of the intercepted part of the first portion and the heat exchange area of the intercepted part of the second portion is approximately an heat exchange area of the flow guiding structure 3 of the intercepted part.

To facilitate understanding, a schematic example is: as shown in FIG. 5, interception at a central angle of 30 degrees ($\alpha$=30 degrees) is taken as an example, a part (corresponding to the central angle of 30 degrees) of the flow guiding structure 3 is added to the intercepted part of the first portion compared to the intercepted part of the second portion, and correspondingly the heat exchange area of this part of the flow guiding structure 3 is added, and the heat exchange efficiency is improved.

In this embodiment, at least a partial length of the flow guiding structure 3 has a preset width. A direction of the width is a direction of a spacing between adjacent two of the fins 1, i.e. the H direction in FIG. 7. The flow guiding flue 6 as a whole, except for the flue gas inlet 4 and the flue gas outlet 5, is a substantially closed flow path, thus flue gas is prevented from overflowing from the flow guiding flue 6 in the flowing process, which ensures the heat exchange efficiency of the heat exchange pipe 500.

In order to form the closed flow path to avoid overflow of flue gas, the preset width is more than 0.9 times the spacing between adjacent two of the fins 1. Of course, the width direction of the flow guiding structure 3 may also be the extending direction/length direction of the pipe body 20, i.e. the H direction in FIG. 7. The length direction of the flow guiding structure 3 is a direction around the pipe body 20, and is perpendicular to the width direction. When the fin 1 has an annular main body, the length direction of the flow guiding structure 3 may be along the circumferential direction.

The preset width may be a range value or a constant value, which can be understood as: the width of a partial length of the flow guiding structure 3 changes when the flow guiding structure 3 extends along the circumferential direction, for example, the width of at least a partial length of the flow guiding structure 3 changes between 0.9 L and L (L is the spacing between two fins 1). Or, at least a partial length of the flow guiding structure 3 extends around the pipe body 20 with a constant width. For example, the width of the entire length of the flow guiding structure 3 is L, and the shape of the flow guiding structure 3 when tiled is a rectangular strip. The at least partial length may be 0.5 times the total length of the flow guiding structure 3. Further, in this embodiment, the entire length of the flow guiding structure 3 has a preset width which is equal to the spacing between two fins 1.

Of course, in other embodiments, the width of the flow guiding structure 3 may even be greater than the spacing between two fins 1, and the flow guiding structure 3 may be provided on adjacent fins 1.

In this embodiment, in adjacent two of the fins 1, the flow guiding structure 3 of one fin 1 is in contact and attached with the other fin 1. In this way the overflow of flue gas can be avoided to the largest extent, the heat exchange efficiency is improved, and the closed flow guiding flue 6 is formed. In addition, by attaching the flow guiding structure 3 to the fin 1, the fin 1 can be positioned while mounted, which facilitates the mounting of the fin 1. To ensure that flue gas flows around the pipe body 20 as much as possible and to avoid outward diffusion thereof, the attaching length of the flow guiding structure 3 accounts for more than 0.8 of the length of the whole flow guiding structure 3. Preferably, the entire length of the flow guiding structure 3 is attached with the fins 1.

To avoid the increase of flue gas flow resistance, at least a partial length of the flow guiding flue 6 extends around the pipe body 20 with a constant flow area. When the flow guiding flue 6 extends around the pipe body 20, the radial dimension of the flow guiding flue 6 does not change. To be specific, as shown in FIG. 5, the spacing between the outer edge 8 of the fin 1 not provided with the flow guiding structure 3 and the outer wall of the pipe body 20 is L1, and the spacing between the flow guiding structure 3 and the pipe body 20 is L2, wherein $0.5L1 \leq L2 \leq 1.5L1$. In this embodiment, the spacing between the flow guiding structure 3 and the pipe body 20 is equal to the spacing between the outer edge 8 of the fin 1 not provided with the flow guiding structure 3 and the outer wall of the pipe body 20, that is, $L2=L1$.

Figure 6:
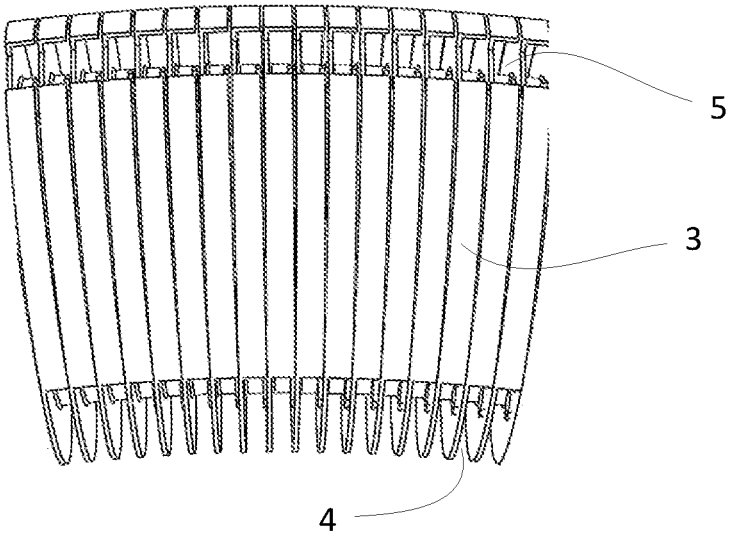
FIG. 6 is an external schematic diagram of a part of the heat exchange pipe in FIG. 1.
Figure 7:
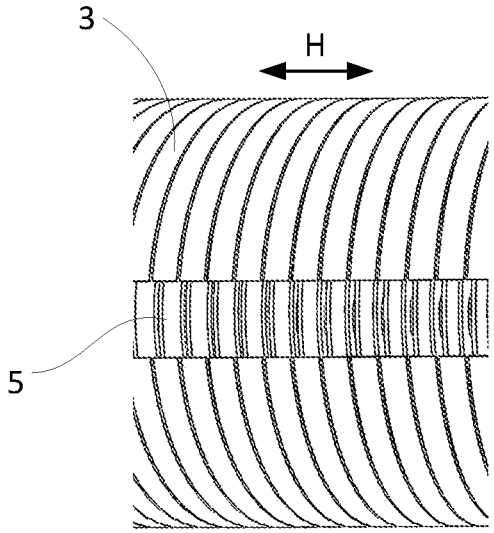
FIG. 7 is another view of FIG. 6.

As shown in FIGS. 6 and 7, between two adjacent fins 1 are a flue gas inlet 4 and a flue gas outlet 5 which are both communicated with the flow guiding flue 6. The two adjacent fins 1 and the outer edge not provided with the flow guiding structure 3 participate in forming the flue gas inlet 4. The heat exchange pipe 500 has an incident side 10 facing flue gas and an effluent side 11 facing away from flue gas. The flue gas outlet 5 is located on the effluent side 11, the flue gas inlet 4 is located on the incident side 10, and the flow guiding structures 3 are located on two sides of the flue gas outlet 5 along a circumferential direction. The flow guiding structures 3 located on the two sides of the flue gas outlet along the circumferential direction have a same length.

For the incident side 10 of the heat exchange pipe 500, flue gas flows towards its surface and thus a better heat exchange effect is achieved. For the effluent side 11, if no flow guiding structure 3 is provided, it is difficult to make flue gas contact and exchange heat with the effluent side 11 because the flue gas will continue to flow forward after passing through the incident side 10, resulting in a poor heat exchange effect on the effluent side 11. In this embodiment, by setting the flow guiding structure 3 and the flow guiding flue 6 formed by the flow guiding structure 3, flue gas flows into the flow guiding flue 6 rather than freely flowing and diffusing after passing through the incident side 10, and exchanges heat with the fin 1 and the pipe body 20 in the flowing process in the flow guiding flue 6, so as to improve the overall heat exchange efficiency of the heat exchange pipe 500. The flow guiding structure 3 covers more than half of the effluent side 11 in a direction around the pipe body 20. Correspondingly, the flow guiding flue 6 covers more than half of the effluent side 11 in a direction around the pipe body 20. Referring to FIGS. 5 and 6, the flow guiding structure 3 has covered a part of the effluent side 11 except for the flue gas outlet 5.

To continue the above description, the flue gas inlet 4 is located at the incident side 10. The length of the flue gas inlet 4 along a circumferential direction is greater than that of the flue gas outlet 5. More than half of the length of the flow guiding structure 3 is located on the effluent side 11. Take the pipe body 20 as a round tube as an example, half of the pipe body 20 is the incident side 10 (corresponding to a central angle of 180 degrees), and the other half of it is the effluent side 11. Preferably, the entire flow guiding structure 3 is located on the effluent side 11, the flue gas inlet 4 is located on the incident side 10, and the central angle that is covered by the flue gas inlet 4 is also 180 degrees. To improve the flue gas gathering and guiding effect, the length of the flue gas inlet 4 along the circumferential direction (direction of the circumference) is less than half of the perimeter of the outer edge 8 of the fin 1. In this embodiment, the length of the flue gas inlet 4 along the circumferential direction is half of the perimeter of the outer edge 8 of the fin 1.

In this embodiment, the spacing between the flow guiding structure 3 and the pipe body 20 is L2; and the length of the flue gas outlet 5 is 0.5L2 to 3L2 (0.5 times L2 to 3 times L2) along a direction around the pipe body 20. For example, the flue gas outlet 5 has a length of 3 mm to 10 mm along the direction around the pipe body 20. The flue gas outlet 5 is located between two flow guiding flangings (flow guiding structures 3). The flow guiding structure 3 constructs a flow guiding flue 6 between the flue gas outlet 5 and the flue gas inlet 4 that communicates the flue gas outlet 5 and the flue gas inlet 4. The ratio of the length of the flow guiding structure 3 to the length of the outer edge 8 of the fin 1 is 0.3 to 0.7 along the direction around the pipe body 20. Preferably, the spacing between the flow guiding structure 3 and the pipe body 20 is L2; and the length of the flue gas outlet 5 is 0.5L2 to 3L2 along the direction around the pipe body 20.

On the pipe body 20, the flue gas outlets 5 of a first number of fins 1 are aligned along an arrangement direction, while the flue gas outlets 5 of a second number of fins 1 are aligned along an arrangement direction and staggered with the flue gas outlets 5 of the first number of fins 1 along the circumferential direction. To be specific, the flue gas outlets 5 of the first number of fins 1 and the flue gas outlets 5 of the second number of fins 1 are staggered by 90 degrees along the circumferential direction. When coiling up the heat exchange pipe 500, the heat exchange pipe of the length corresponding to the first number of fins 1 may form an inner coiled pipe, and the heat exchange pipe of the length corresponding to the second number of fins 1 may form an outer coiled pipe.

Based on the same idea, the embodiments of the present disclosure also provide a heat exchanger and a water heating apparatus as described in the following embodiments. Since the principles by which the heat exchanger and the water heating apparatus solve problems and the technical effects achieved are similar to that of the heat exchange pipe 500, reference can be made to the implementation of the heat exchange pipe 500 described above for the implementation of the heat exchanger and water heating apparatus. No redundant depiction will be given here for the repeated content.

Continuing to refer to FIGS. 1 to 9, an embodiment of the present disclosure also provides a heat exchanger, comprising a spirally coiled heat exchange pipe 500. The heat exchange pipe 500 comprises a pipe body 20 and a plurality of fins 1 fixedly disposed to sleeve the pipe body 20. A flow guiding structure 3 is provided at a partial outer edge 8 of the fin 1, and a flow guiding flue 6 is formed between the flow guiding structure 3 and an outer wall of the pipe body 20. The heat exchange pipe 500 may be the heat exchange pipe 500 described in any of the above embodiments. No redundant depiction will be given here for the repeated content.

To prevent flue gas from escaping between the heat exchange pipes 500 and facilitate flue gas entering the flow guiding flue 6, the outer edges 8 of the fins 1 of adjacent two circles of the heat exchange pipe 500 are attached to each other. The attaching position on the inner coiled pipe 300 may be an end portion of the flow guiding structure 3 or a boundary position between the flue gas inlet 4 and the flow guiding structure 3. In this way, it is possible to avoid formation of other flue gas emission paths between two adjacent circles of the heat exchange pipe 500, so that flue gas enters the flow guiding flue 6 as much as possible after passing through the flue gas inlet 4, allowing all flue gas to participate in the heat exchange with the pipe body 20 and the fin 1 on the effluent side 11, thereby improving the heat exchange efficiency.

Figure 2:
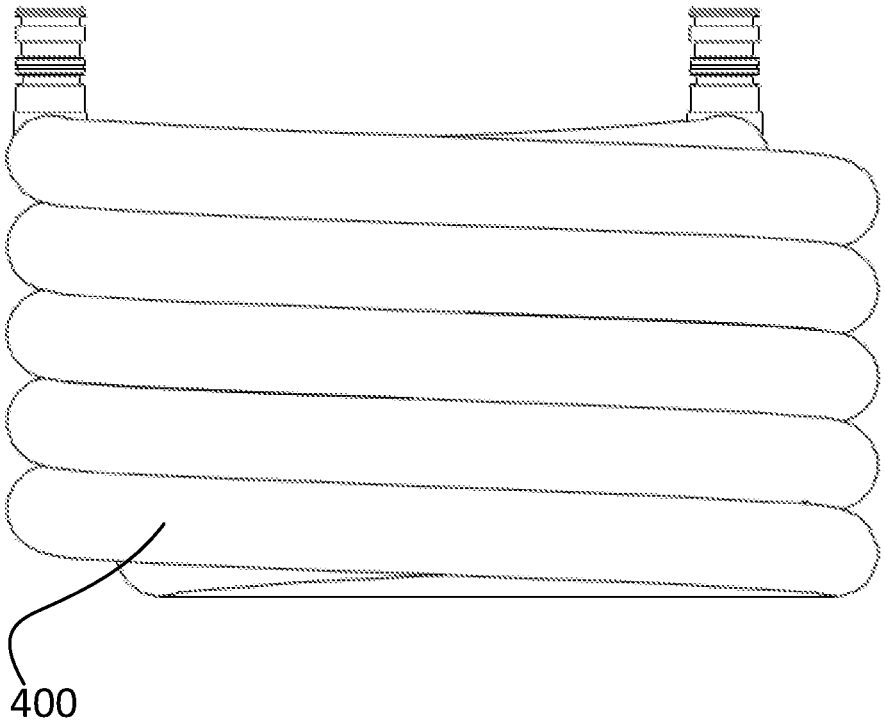
FIG. 2 is a schematic diagram of the heat exchange pipe in FIG. 1.
Figure 3:
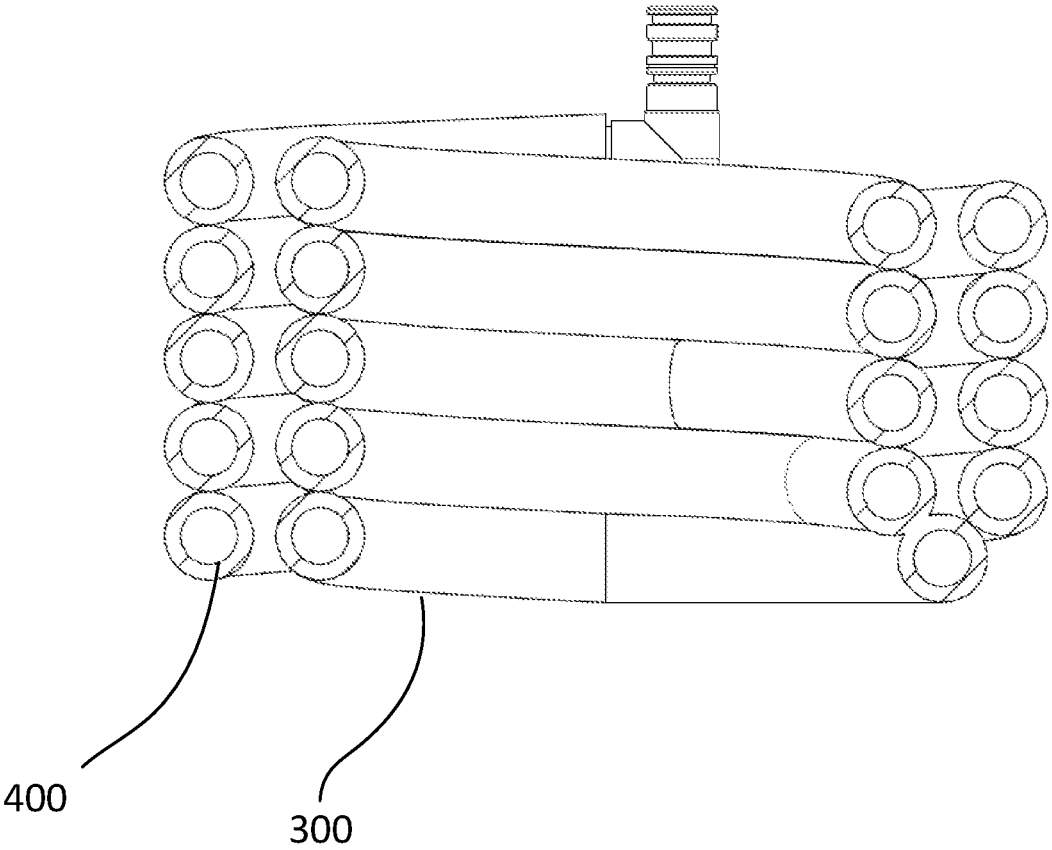
FIG. 3 is a cutaway view of FIG. 2.

In this embodiment, as shown in FIGS. 1, 2 and 3, the heat exchange pipe 500 comprises an inner coiled pipe 300 and an outer coiled pipe 400 surrounding the inner coiled pipe 300. A partition board 600 is provided between the inner coiled pipe 300 and the outer coiled pipe 400. The flue gas outlet 5 of the flow guiding flue 6 of the inner coiled pipe 300 faces the partition board 600. By provision of the partition board 600, the heat exchange pipe 500 of the heat exchanger can be divided into a combustion section and a condensation section.

The heat exchanger has a shell 100 which as a whole is a hollow cylinder. The partition board 600 in the shell 100 is a cylindrical structure, and is located between the outer coiled pipe 400 and the inner coiled pipe 300. The side wall of the shell 100 has a gas exhaust port 700 which is substantially located on one end of the shell 100 and opens into the shell 100. An external space for accommodating the outer coiled pipe 400 is formed between the partition board 600 and the shell 100. To avoid flue gas flowing outside the heat exchange pipe 500 and make flue gas flowing in the flow guiding flue 6 as much as possible so as to improve the heat exchange effect, the spacing between the shell 100 and the partition board 600 may be equal to the outer diameter of the heat exchange pipe 500 (outer diameter of the outer edge 8 of the fin 1). The outer coiled pipe 400 is attached with the inner wall of the shell 100 and the outer wall of the partition board 600.

The outer coiled pipe 400 spirally coils up around a central axis. Correspondingly, the inner coiled pipe 300 also spirally coils up around the central axis. The orientation of the flue gas outlet 5 of the outer coiled pipe 400 is parallel to the central axis. To be specific, in the outer coiled pipe 400, the flue gas outlet 5 of the flow guiding flue 6 of one circle of the heat exchange pipe 500 faces the flue gas inlet 4 of the flow guiding flue 6 of a next circle of the heat exchange pipe 500. The orientation of the flue gas outlet 5 of the outer spirally coiled pipe 400 is perpendicular to the orientation of the flue gas outlet 5 of the inner coiled pipe 300. The orientation of the flue gas outlet 5 of the inner coiled pipe 300 is perpendicular to the partition board 600. The orientation of the flue gas outlet 5 of the outer coiled pipe 400 is parallel to the partition board 600.

In this embodiment, the partition board 600 in the heat exchanger only needs to be placed between the outer coiled pipe 400 and the inner coiled pipe 300, so that the installation is easier. The interior of the inner coiled pipe 300 is a combustion chamber 200, and the inner coiled pipe 300 surrounds the combustion chamber 200. Flue gas flows outward from the inner coiled pipe 300, wherein the opening of the flue gas inlet 4 faces inward and the opening of the flue gas outlet 5 faces outward. Flue gas first enters the flow guiding flue 6 on the upper and lower sides (based on the orientation facing FIG. 8) through the flue gas inlet 4, and, while outward diffusion is avoided, the flue gas flows around the pipe body 20 and exchanges heat fully with the pipe body 20 and the fin 1, so that the heat exchange efficiency is improved. When flue gas is emitted from the flue gas outlet 5, it can be seen that most parts of the pipe body 20 has contacted and exchanged heat with the flue gas. Hence, uneven heat exchange on the incident side 10 and the effluent side 11 of the pipe body 20, which will lead to a great temperature difference and affect the heat exchange efficiency, is avoided.

Figure 8:
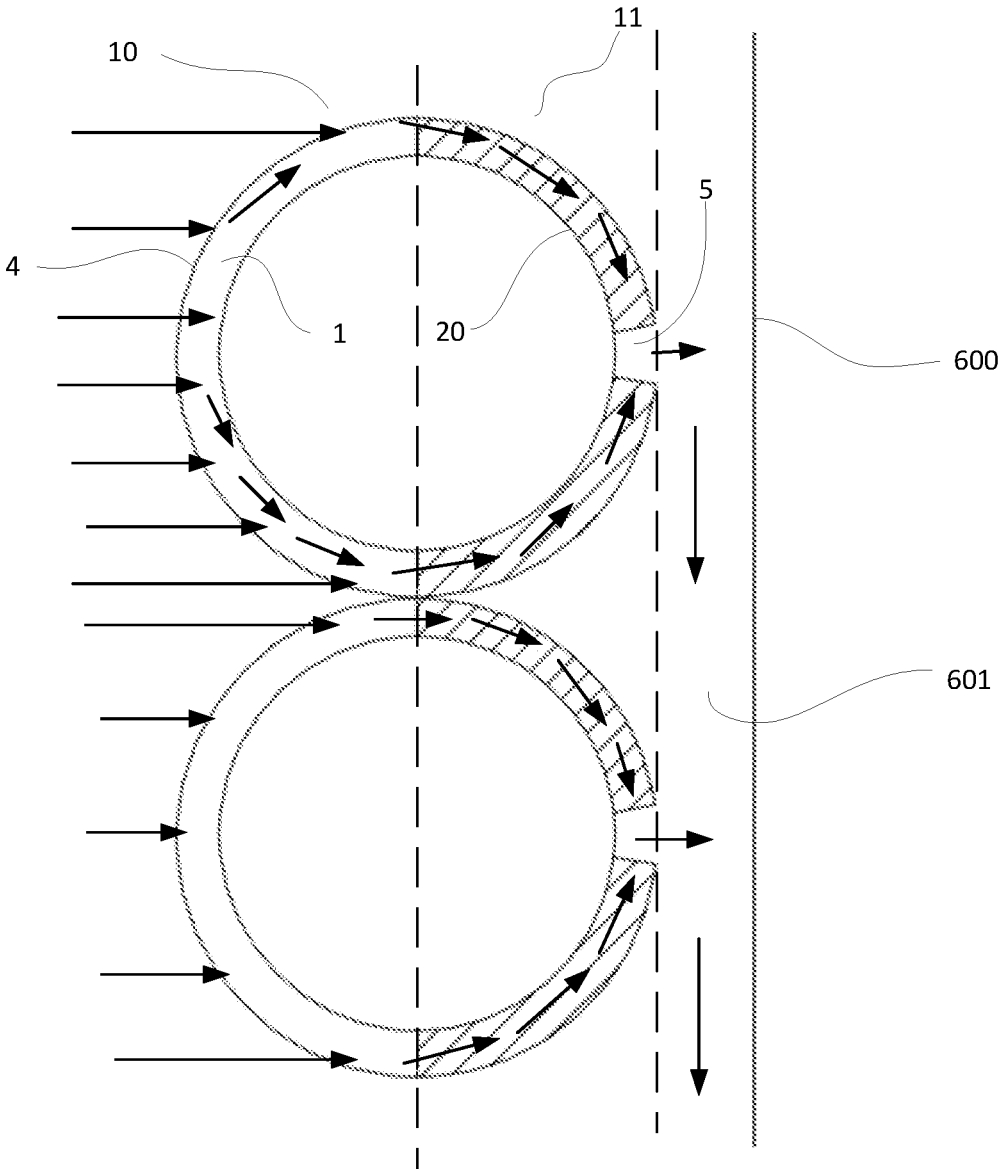
FIG. 8 is a diagram of the flue gas flow path of the inner coiled pipe in FIG. 2.
Figure 9:
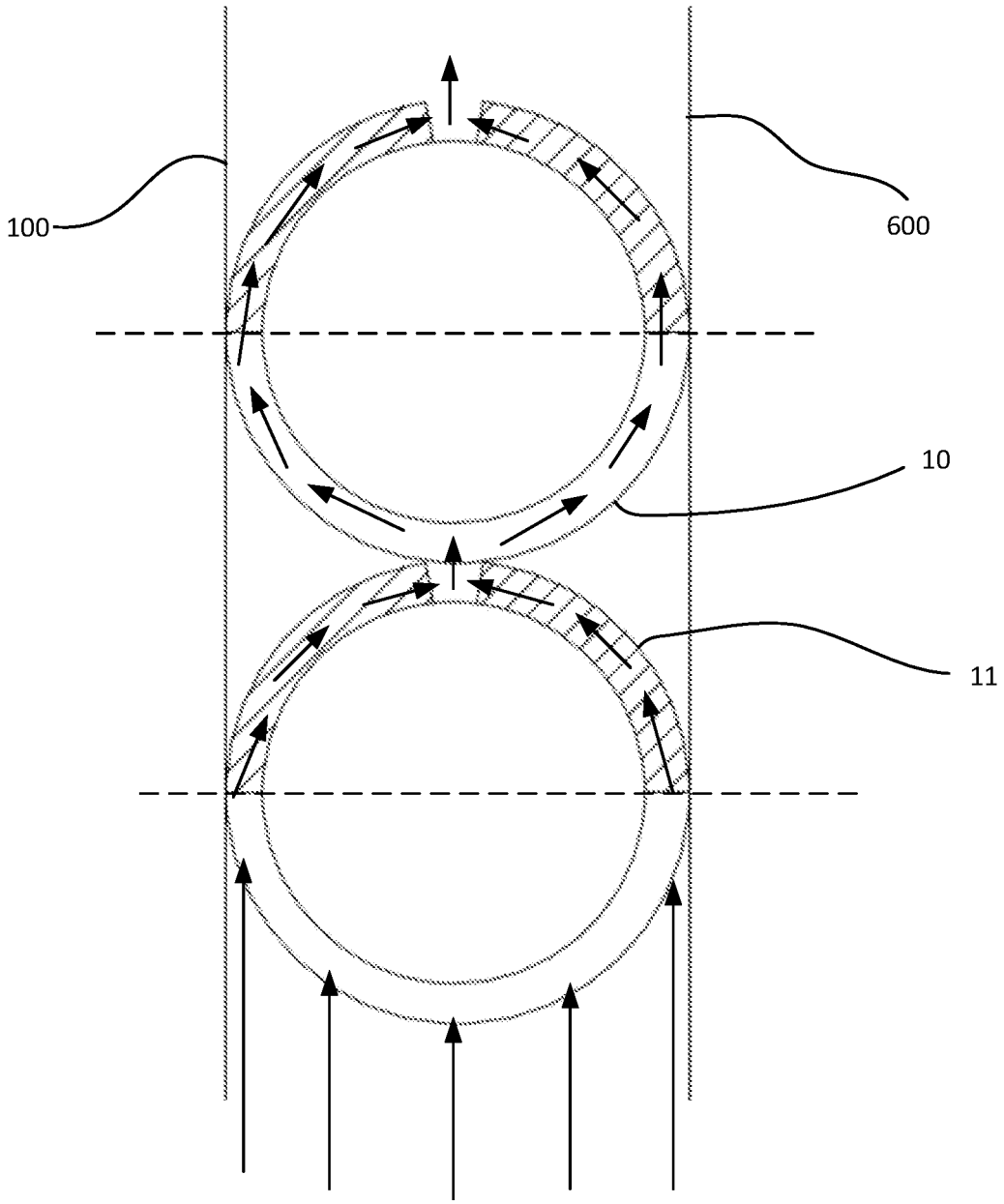
FIG. 9 is a diagram of the flue gas flow path of the outer coiled pipe in FIG. 2.

In this embodiment, as shown in FIGS. 8 and 9, a flue gas flow gap 601 is formed between the partition board 600 and the inner coiled pipe 300. Flue gas, after being emitted from the flue gas outlet 5, enters the flue gas flow gap 601 and flows downwardly until reaching the flow guiding flue 6 of the bottom heat exchange pipe 500, and then enters the external space through the flue gas outlet 5 of the bottom heat exchange pipe 500 and enters the flow guiding flue 6 of the heat exchange pipe 500 from the flue gas inlet 4 which opens downwardly, and thereafter flows around the pipe body 20 through the flow guiding flue 6 until being emitted from the flue gas outlet 5. The flue gas outlet 5 is opposite to the middle position of the flue gas inlet 4 of a next circle of the heat exchange pipe 500. The flue gas emitted from the flue gas outlet 5 enters the flue gas inlet 4 and flows around the pipe body 20 towards both sides of it until entering the flow guiding flue 6, and at last is emitted from the flue gas outlet 5. The flue gas flows stepwise until being emitted from the top heat exchange pipe 500, and is at last emitted out of heat exchanger through the gas exhaust port 700.

An embodiment of the present disclosure also provides a water heating apparatus comprising the heat exchanger according to any one of the above embodiments. This water heating apparatus may be a gas water heating device. More specifically, the water heating apparatus may be a gas water heater, a wall-hanging stove or a condensing type water heater. Of course, the water heating apparatus may also be a heating stove.

Any numeral values cited herein include all values of the lower values and the upper values from the lower limiting value to the upper limiting value, in increments of one unit, provided that there is a separation of at least two units between any lower value and any higher value. For example, if the value illustrating the number or process variable (such as temperature, pressure and time, etc.) of a component is from 1 to 90, preferably from 20 to 80, and more preferably from 30 to 70, then the purpose is to explain that the Description also explicitly enumerates values such as 15 to 85, 22 to 68, 43 to 51 and 30 to 32. For values which are less than one, one unit is appropriately considered to be 0.0001, 0.001, 0.01 or 0.1. These are only examples of what is specifically intended, and all possible combinations of numerical values between the lowest value and the highest value enumerated, are all expressly stated in the Description in similar ways.

Unless otherwise stated, all numerical ranges include the endpoints and all numbers that fall between the endpoints. The use of "about" or "approximately" in connection with a range applies to both ends of the range. Therefore, "about 20 to 30" is intended to cover "about 20 to about 30", inclusive of at least the specified endpoints.

All articles and reference documents, including patent applications and publications, disclosed herein are incorporated by reference. The term "substantially formed of . . . " describing combinations should include the determined elements, components, parts or steps as well as other elements, components, parts or steps that do not affect the basic novel features of the combination in substance. The use of the terms "contain" or "include" to describe the combinations of elements, components, parts or steps herein also give rise to the embodiments constituted substantially by these elements, components, parts or steps. The term "may" as used herein is intended to explain that any attribute included by the "may" as described is selectable.

Plural elements, components, parts or steps can be provided by a single integrated element, component, part or step. Alternatively, a single integrated element, component, part or step might be divided into separate plural elements, components, parts or steps. The disclosed "a" or "an" used for describing elements, components, parts or steps do not exclude other elements, components, parts or steps.

It is to be understood that the above description is intended to be graphically illustrative and not restrictive. Many embodiments and applications other than the examples provided would be apparent to those skilled in the art upon reading the above description. Therefore, the scope of the present teaching should be determined not with reference to the above description but should, instead, be determined with reference to the appended claims, along with their full scope of equivalents. The disclosures of all articles and references, including patent applications and publications, are incorporated by reference for all purposes. The omission in the foregoing claims of any aspect of the subject matter that is disclosed herein is not a disclaimer of the subject matter, nor should it be regarded that the inventors did not consider the subject matter to be a part of the disclosed subject matter of the disclosure.

What is claimed is:

1. A heat exchange having a spirally coiled heat exchange pipe which comprises a pipe body and a plurality of fins fixedly disposed to sleeve the pipe body;

wherein a flow guiding structure is provided at an outer edge of a fin of the plurality of fins;

wherein a flow guiding flue is formed between the flow guiding structure and an outer wall of the pipe body;

wherein the heat exchange pipe comprises an inner coiled pipe and an outer coiled pipe surrounding the inner coiled pipe;

wherein a partition board is provided between the inner coiled pipe and the outer coiled pipe;

wherein a flue gas outlet of the flow guiding flue of the inner coiled pipe faces the partition board;

wherein the outer coiled pipe is spirally coiled around a central axis; and wherein an orientation of the flue gas outlet of the outer coiled pipe is parallel to the central axis.

2. The heat exchanger according to claim 1, wherein the fin has a first portion in which the outer edge is provided with the flow guiding structure, and a second portion in which the outer edge is not provided with the flow guiding structure; in a case where a part of the fin is intercepted at a same central angle, a heat exchange area of an intercepted part of the first portion is larger than that of an intercepted part of the second portion.

3. The heat exchanger according to claim 2, wherein in a case where a part of the fin is intercepted at a same central angle, a difference between the heat exchange area of the intercepted part of the first portion and the heat exchange area of the intercepted part of the second portion is approximately a heat exchange area of the flow guiding structure of the intercepted part.

4. The heat exchanger according to claim 1, wherein at least a partial length of the flow guiding structure has a preset width; a direction of the width is a direction of a spacing between the fin and an adjacent fin of the plurality of fins; and the preset width is more than 0.9 times the spacing between the fin and the adjacent fin.

5. The heat exchanger according to claim 1, wherein the fin is in contact and attached with an adjacent fin of the plurality of fins.

6. The heat exchanger according to claim 5, wherein an attaching length of the flow guiding structure accounts for more than 0.8 of a length of the whole flow guiding structure.

7. The heat exchanger according to claim 1, wherein at least a partial length of the flow guiding structure extends around the pipe body with a constant width.

8. The heat exchanger according to claim 1, wherein at least a partial length of the flow guiding flue extends around the pipe body with a constant flow area.

9. The heat exchanger according to claim 1, wherein a spacing between the outer edge of the fin that is not provided with the flow guiding structure and an outer wall of the pipe body is L1, and a spacing between the flow guiding structure and the pipe body is L2, wherein $0.5L1 \leq L2 \leq 1.5L1$.

10. The heat exchanger according to claim 1, wherein the flow guiding structure extends along a circumferential direction.

11. The heat exchanger according to claim 1, wherein the flow guiding structure is integrated with the fin, and the flow guiding structure is a flow guiding flanging located at the outer edge of the fin.

12. The heat exchanger according to claim 1, wherein the outer edge of the fin and an outer edge of an adjacent fin of the plurality of fins circle the heat exchange pipe and are attached to each other.

13. A water heating apparatus comprising the heat exchanger according to claim 1.

14. A heat exchange having a spirally coiled heat exchange pipe which comprises a pipe body and a plurality of fins fixedly disposed to sleeve the pipe body, wherein a flow guiding structure is provided at an outer edge of a fin of the plurality of fins;

wherein a flow guiding flue is formed between the flow guiding structure and an outer wall of the pipe body, wherein the heat exchange pipe comprises an inner coiled pipe and an outer coiled pipe surrounding the inner coiled pipe;

wherein a partition board is between the inner coiled pipe and the outer coiled pipe;

wherein a flue gas outlet of the flow guiding flue of the inner coiled pipe faces the partition board; and wherein in the outer coiled pipe, the flue gas outlet of the flow guiding flue of one circle of the heat exchange pipe faces the flue gas inlet of the flow guiding flue of a next circle of the heat exchange pipe.

15. The heat exchanger according to claim 14, wherein the fin has a first portion in which the outer edge is provided with the flow guiding structure, and a second portion in which the outer edge is not provided with the flow guiding structure; in a case where a part of the fin is intercepted at a same central angle, a heat exchange area of an intercepted part of the first portion is larger than that of an intercepted part of the second portion.

16. The heat exchanger according to claim 15, wherein in a case where a part of the fin is intercepted at a same central angle, a difference between the heat exchange area of the intercepted part of the first portion and the heat exchange area of the intercepted part of the second portion is approximately a heat exchange area of the flow guiding structure of the intercepted part.

17. The heat exchanger according to claim 14, wherein at least a partial length of the flow guiding structure has a preset width; a direction of the width is a direction of a spacing between the fin and an adjacent fin of the plurality of fins; and the preset width is more than 0.9 times the spacing between the fin and the adjacent fin.

18. The heat exchanger according to claim 14, wherein the fin is in contact and attached with an adjacent fin of the plurality of fins.

19. The heat exchanger according to claim 18, wherein an attaching length of the flow guiding structure accounts for more than 0.8 of a length of the whole flow guiding structure.

20. The heat exchanger according to claim 14, wherein at least a partial length of the flow guiding structure extends around the pipe body with a constant width.

21. The heat exchanger according to claim 14, wherein at least a partial length of the flow guiding flue extends around the pipe body with a constant flow area.

22. The heat exchanger according to claim 14, wherein a spacing between the outer edge of the fin that is not provided with the flow guiding structure and an outer wall of the pipe body is L1, and a spacing between the flow guiding structure and the pipe body is L2, wherein $0.5 \leq L1 \leq L2 \leq 1.5L1$.

23. The heat exchanger according to claim 14, wherein the flow guiding structure extends along a circumferential direction.

24. The heat exchanger according to claim 14, wherein the flow guiding structure is integrated with the fin, and the flow guiding structure is a flow guiding flanging located at the outer edge of the fin.

25. The heat exchanger according to claim 14, wherein the outer edge of the fin and an outer edge of an adjacent fin of the plurality of fins circle the heat exchange pipe and are attached to each other.

26. A water heating apparatus comprising the heat exchanger according to claim 14.

27. A heat exchange having a spirally coiled heat exchange pipe which comprises a pipe body and a plurality of fins fixedly disposed to sleeve the pipe body, wherein a flow guiding structure is provided at an outer edge of a fin of the plurality of fins;

wherein a flow guiding flue is formed between the flow guiding structure and an outer wall of the pipe body, wherein the heat exchange pipe comprises an inner coiled pipe and an outer coiled pipe surrounding the inner coiled pipe;

wherein a partition board is provided between the inner coiled pipe and the outer coiled pipe;

wherein a flue gas outlet of the flow guiding flue of the inner coiled pipe faces the partition board;

wherein the flue gas inlet communicated with the flow guiding flue and the flue gas outlet communicated with the flow guiding flue are provided between the fin and an adjacent fin of the plurality of fins;

wherein the heat exchange pipe has an incident side facing flue gas and an effluent side facing away from the flue gas; the flue gas outlet is located on the effluent side, and the flow guiding structure is located on two sides of the flue gas outlet along a circumferential directions;

wherein each of the plurality of fins includes the flue gas outlet, and wherein the flue gas outlets of a first number of the plurality of fins and the flue gas outlets of a second number of the plurality of fins are staggered by 90 degrees along the circumferential direction.

28. The heat exchanger according to claim 27, wherein the flow guiding structure located on a first side of the flue gas outlet and the flow guiding structure located along a second side of the flue gas outlet along the circumferential direction have a same length.

29. The heat exchanger according to claim 27, wherein the flue gas inlet is located on the incident side; and a length of the flue gas inlet along the circumferential direction is larger than that of the flue gas outlet.

30. The heat exchanger according to claim 27, wherein more than half of a length of the flow guiding structure is located on the effluent side.

31. The heat exchanger according to claim 27, wherein a length of the flue gas inlet along the circumferential direction is less than half of a perimeter of the outer edge of the fin.

32. The heat exchanger according to claim 27, wherein a spacing between the flow guiding structure and the pipe body is L2; and a length of the flue gas outlet is 0.5L2 to 3L2 along a direction around the pipe body.

33. The heat exchanger according to claim 27, wherein a ratio of a length of a flow guiding flanging to a length of the outer edge of the fin is 0.3 to 0.7 along a direction around the pipe body.

34. The heat exchanger according to claim 27, wherein each of the plurality of fins includes the flue gas outlet, and wherein on the pipe body, the flue gas outlets of a first number of the plurality of fins are aligned along an arrangement direction, while the flue gas outlets of a second number of the plurality of fins are aligned along the arrangement direction and are staggered with the flue gas outlets of the first number of fins along the circumferential direction.

35. A water heating apparatus comprising the heat exchanger according to claim 27.

* * * * *